United States Patent [19]

Shore

[11] 4,118,890

[45] Oct. 10, 1978

[54] PLANT PACKAGE

[76] Inventor: William S. Shore, 28126 Gates Mills, Pepper Pike, Ohio 44124

[21] Appl. No.: 768,976

[22] Filed: Feb. 16, 1977

[51] Int. Cl.[2] ..... A01G 9/02; A47G 7/08

[52] U.S. Cl. ..... 47/28 R; 47/69; 47/84; 206/423

[58] Field of Search ..... 47/19, 28, 29, 66, 69, 47/72, 73, 74, 76, 77, 84, DIG. 2, DIG. 7, 17, 26, 32; 428/518, 519; 206/423

[56] References Cited

U.S. PATENT DOCUMENTS

| | | | |
|---|---|---|---|
| 1,988,886 | 1/1935 | Wilson | 206/423 |
| 2,017,308 | 10/1935 | Elmer | 47/77 |
| 2,341,374 | 2/1944 | Gardner | 47/84 |
| 2,664,670 | 1/1954 | Mulford | 47/84 |
| 2,994,424 | 8/1961 | Selby et al. | 206/423 |
| 3,094,810 | 6/1963 | Kalpin | 47/28 X |
| 3,266,188 | 8/1966 | Budd | 47/28 |
| 3,302,325 | 2/1967 | Ferrand | 47/74 |
| 3,320,697 | 5/1967 | Larsen | 47/69 |
| 3,462,061 | 8/1969 | Shore | 229/37 R |
| 3,640,381 | 2/1972 | Kanada | 229/55 X |
| 3,738,956 | 6/1973 | Glatti et al. | 47/17 |
| 3,962,823 | 6/1976 | Zipperer | 206/423 X |
| 3,995,396 | 12/1976 | Spector | 47/69 |
| 4,006,561 | 2/1977 | Thoma et al. | 206/423 |
| 4,019,279 | 4/1977 | Moorman et al. | 47/73 X |

FOREIGN PATENT DOCUMENTS

| | | | |
|---|---|---|---|
| 455,630 | 7/1968 | Switzerland | 206/423 |

*Primary Examiner*—Edgar S. Burr
*Assistant Examiner*—James R. Feyrer
*Attorney, Agent, or Firm*—Bosworth, Sessions & McCoy

[57] ABSTRACT

A plant package is disclosed which protects and maintains the plant during shipment, storage and display and which permits the marketing of plants through self-service outlets. The package has an outer light-transmissive plastic container which is generally prismatic-shaped with a polygonal cross section. The container has generally flat rectangular side panels connected by upright supporting seams. The container is hermetically sealed, and preferably inflated. Within the container, there is a flexible closed bag which contains the plant roots and soil. The soil bag has holes therein for the transmission of moisture from the bottom of the container to the plant roots.

23 Claims, 5 Drawing Figures

FIG. 1
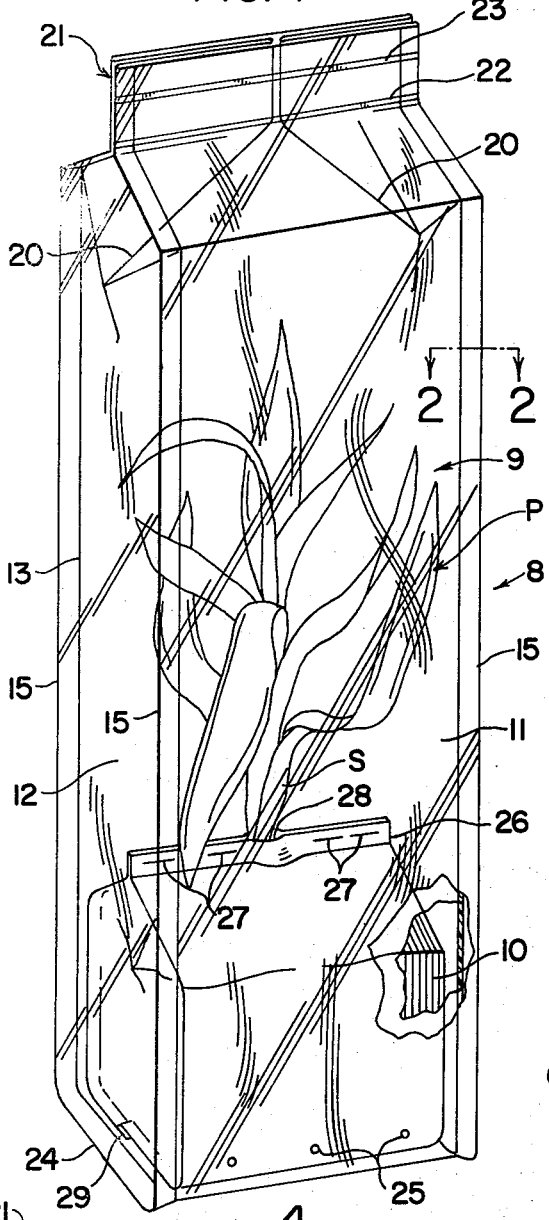
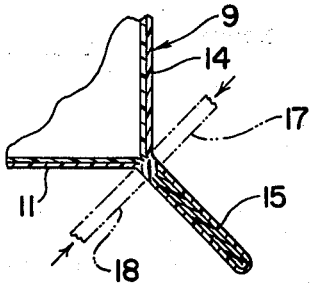
FIG. 2
FIG. 5
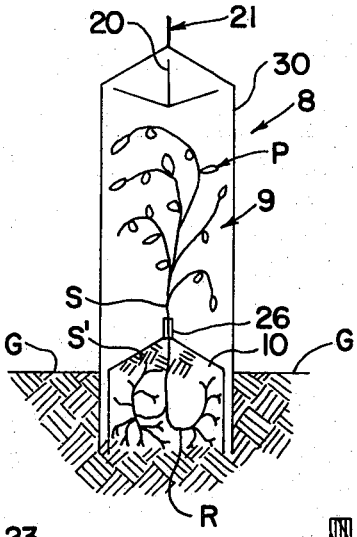
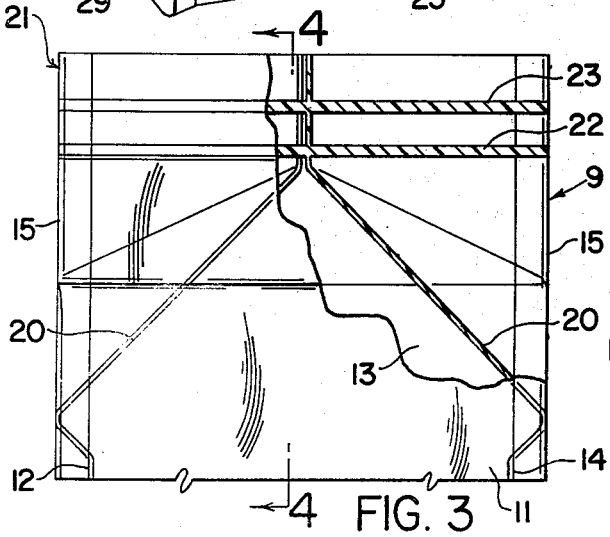
FIG. 3
FIG. 4
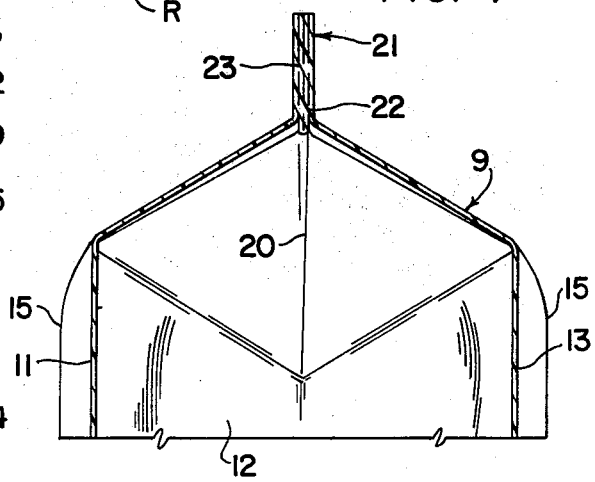

PLANT PACKAGE

BACKGROUND OF THE INVENTION

Most live plants are fragile and require special attention in shipment, storage, and marketing. Live plants must be treated with extreme care, watered regularly, and protected from insects, fungus, and bacteria. The plant must also be protected from handling by potential customers, but at the same time be subject to customer inspection prior to purchase. Because of these requirements, the sale of plants has usually been accomplished through special outlets in which experienced personnel are at hand to care for the plants and to exercise personal control while the plant is being displayed to the customer.

It would be desirable to market live plants directly through super markets and other self-service retail establishments in which special personnel are not available. However, the packages for live plants known heretofore have not been adapted for adequately protecting and displaying the plant under these circumstances. For example, in an early package design shown in U.S. Pat. No. 1,988,886, the package wraps around the plant and the roots to provide a moisture-proof seal, thereby eliminating the need for watering, but it does not provide an effective protection for the plant during handling nor is it suitable for display when marketing since it is not upstanding and since it does not provide for inspection of the plant prior to purchase.

In U.S. Pat. No. 2,664,670, a rigid package is shown which provides better protection for the plant. However, this package is not designed to be moisture-proof. Holes have to be put in the wrapper for watering the plant. Furthermore, the plant is potted in a heavy pot which is not suitable for plant shipment because it adds weight and cost to the package and because it must be secured within the package to prevent damage to the plant if the package is tipped over. The pot may also be unwanted by the potential purchaser who intends to transplant his purchase. The rigid design is also less desirable than a flexible design which is better adapted to packing during shipment and storage and which affords better protection to the plant.

In U.S. Pat. Nos. 2,774,187 and 2,994,424 packages have been designed for the shipment and storage of cut flowers. Both of these patents employ sealed transparent containers which maintain the cut flowers in a moisture controlled environment. These containers, however, are intended to be used when the flowers are given special fragile treatment and are not designed to protect the flowers against rough handling normally experienced during shipment. These packages are also not adaptable for use with live plants since no provision is made for the plant roots and soil. Furthermore, these packages have an irregular baggy shapes, making packing difficult.

In U.S. Pat. No. 3,320,697 a similar bag-like wrapping is used around a potted plant. This design is also not adapted for packing and shipment because it has an irregular shape which does not facilitate the placement of plurality of such containers in a shipping container and because there is no protection to the plant or to the soil and roots if the package is knocked over during shipment and handling. This design has a heavy expensive pot which is unsuitable for shipment.

SUMMARY OF THE INVENTION

The shortcomings of these prior art plant packages are overcome by the plant package of the present invention. This invention permits the marketing of live plants in self-service retail outlets, such as supermarkets and variety stores, without the necessity of employing special personnel to care for the plants and to exercise control over their display. At the same time, the package protects the plant and promotes healthy plant growth during the retailing operation so that the plants sold in these packages may have an extended shelf life. This invention provides a sealed container which maintains the plant in a moist environment without regular watering, protecting the plant from insects, fungus, and bacteria. The container is transparent to allow light to be transmitted to the plant and to allow visual inspection of the plant. The container is generally prismatic-shaped, preferably shaped similar to a rectangular prism, with generally flat rectangular side panels, resulting in maximum utilization of packing space during storage and shipment of the containers. In addition, the package eliminates the necessity of a heavy rigid plant pot which is ill-suited for shipment and handling.

The plant package of this invention comprises an outer plastic container and an inner soil bag. The outer container is flexible, transparent, hermetically sealed and preferably inflated. The container is generally prismatic-shaped with a polygonal, or preferably rectangular, cross section and generally flat rectangular side panels connected by upright supporting seams. The inner bag contains the plant roots and soil. The soil bag is flexible and closed, but not sealed. The bag has an opening for the plant stem and a plurality of moisture transmitting holes therein.

BRIEF DESCRIPTION OF THE DRAWINGS

FIG. 1 is a perspective view of the plant package of the present invention.

FIG. 2 is a detailed sectional view taken along line 2—2 of FIG. 1 showing the construction of the reinforcing seams.

FIG. 3 is an elevational view partially sectioned of the construction of the upper portion of the plant package of FIG. 1.

FIG. 4 is a sectional view taken along line 4—4 of FIG. 3.

FIG. 5 is a view depicting a use of the package as a protective covering for plants during early planting season.

DETAILED DESCRIPTION OF THE PREFERRED EMBODIMENTS

Referring more particularly to the drawings and initially to FIG. 1, there is shown a plant package 8 of the present invention. The package 8 comprises a light-transmissive generally prismatic-shaped container 9 containing a plant P. The container 9 is formed generally in a shape of a regular prism with a polygonal cross-section and comprising a plurality of generally flat rectangular-like side panels 11, 12, 13 and 14, which are connected and sealed at each corner by upstanding reinforcing seams 15 and which are folded and sealed at the top and bottom, so that the entire container 9 is hermetically sealed. The container 9 is also inflated slightly prior to sealing to provide further protection for the plant. To permit the maximum utilization of storage and shipping space, the regular-prism shape is preferably a rectangular parallelpiped so that the polygonal cross section is rectangular with four rectangular-like side panels as shown, allowing the packages to be packed closely together with a minimum of wasted space.

The container 9 is made from an extruded plastic film, preferably a multiple-layered film comprising an inner layer of low density polyethylene and an outer layer of polypropylene. While these materials are preferred because of their temperature range, stiffness, yield, and fabricating ability, it is understood that other thermoplastics may be suitable for this invention. It is necessary that the plastic be transparent for the transmission of light to the leaves of the plant, for a proper merchandizing display of the plant product and for the inspection of the plant by potential purchasers. The plastic film has a preferred thickness of at least 3 mils and preferably in the range of 3 to 5 mils for a typical container having cross sectional dimensions of 3 to 6 inches in width.

The multiple-layered plastic film of polypropylene and polyethylene is also preferred because of its slight permeability permitting an osmosis of gases through the film. It is known that plants go through a daily cycle in which basically the plant uses carbon dioxide and water during the "day" period in a photosynthesis process with light to produce glucose, and give off oxygen, and in which the plant uses oxygen during the "night" period to produce carbon dioxide. As a result, the environment within the package is carbon dioxide poor and oxygen rich during the day, and is carbon dioxide rich and oxygen poor at night. Since the preferred film is permeable by gas molecules, an osmosis of gases takes place so that carbon dioxide and oxygen are exchanged between the environment of the package and the outer atmosphere to maintain a suitable environment for the plant at all times. For example, using ASTM test standard D 1434 on the basis of the preferred film having a thickness of 4 mils with a 1-mil inner layer of low density polyethylene and a 3-mil outer layer of polypropylene, the permeability of oxygen is 70 cc of gas per 100 sq. in. of film surface per 24 hours per 1 atmosphere pressure differential, and the permeability of carbon dioxide is 175 cc per 100 sq. in per 24 hours per 1 atmosphere. This osmotic balance assures that the plant has available the necessary gases continuously during its daily cycle.

While the film is permeable by gas molecules, it is not permeable by water or by other larger elements such as by bacteria, fungus and insects. For example, using ASTM test standard E 96 on the basis of the preferred 4-mil film as described above, the permeability of water is only 0.3 gm per 100 sq. in. per 24 hours per 1 atmosphere, indicating that the loss of water from the container is almost negligible. The film is also impenetrable by bacteria, fungus and insects, and particularly it is extremely reistant to boring insects which would ordinarily enter the plant environment and destroy the health of the plant. Thus, the film has properties allowing the necessary gases to enter or leave the package environment, while at the same time preventing the escape from the package of water which is necessary to sustain the plant and preventing the entrance into the package of destructive elements such as insects which would damage the plant.

To reduce the effect of fogging within the container, the inner layer of the container 9 is treated with a surfactant. When the preferred inner layer of polyethylene film is used, the surfactant may be tumbled or mixed with the polyethlene prior to extrusion of the polyethylene film. Preferably, approximately 0.25% of surfactant to polyethylene resin is used. Any suitable known surfactant may be used, including nonionic, anionic, and cationic surfactants, such as those available from ICI America Inc. (formerly Atlas Chemical Industries, Inc.) or other suppliers. The surfactant reduces the surface tension of water droplets forming on the inside surface of the container and thus prevents the formation of large water droplets. The prevention of large water droplets serves two purposes. First, the absence of such droplets prevents fogging on the inside surface of the container. This fogging would otherwise decrease visibility to the potential customer who wished to examine the plant and would decrease the amount of light transmitted to the leaves of the plant. Second, the absence of large water droplets prevents the leaves of the plant which may rest against the inside of the package from being drowned by the continual contact with water. Such contact may result in damage or "burning" of the tissues of the plant.

The structure of the container 9 is somewhat similar in certain respects to the structure of the containers disclosed in the present inventor's prior U.S. Pat. Nos. 3,434,652, 3,462,061 and 3,462,067, and comprises several side panels 11, 12, 13 and 14. At each corner of the container, the upstanding seams 15 connect and seal together the side panels. The seams 15 also reinforce the container structure and maintain the prismatic-like structure even when the pressure inside the container decreases due to osmosis. The construction of one of the seams 15 is shown in detail in FIG. 2. Each seam 15 comprises an overlapping of the sides of the adjacent side panels, such as panels 11 and 14 in FIG. 2. Each of these reinforcing seams 15 is integrally formed in a continuous process by any known means 17 and 18, such as by pairs of heated opposed rollers or jaws or by an ultrasonic process.

The top and bottom of the containers 9 are closed by a folding technique which is similar to that disclosed in the aforementioned patents and which is shown in detail in FIGS. 3 and 4. At the top of the container, the centers of the side panels 12 and 14 are folded inwardly to form tucks 20, and the tops of the panels 11 and 13 brought together over the tucks 20. The container can then be sealed along the adjacent top edges 21 of panels 11 and 13; the top edges of panels 12 and 14 are folded between the top edges of panels 11 and 13 and the entire container is thus sealed across the top edge 21. To hermetically seal the container while inflating the inside of the container slightly above atmospheric pressure, a double seal is employed. After the plant and bag have been inserted within the container 9, an inflation means is inserted through the center of the top edge 21, and the pressure of the interior of the container is increased so that the container is slightly inflated. When the inflation step is completed, a set of sealing jaws is quickly applied to the top edge of the container forming a bottom seal 22 and a top seal 23 which hermetical seals the container in the slightly inflated state. A similar folding and sealing construction may be employed for the bottom 24 of the container.

The purposes of inflating the container 9 prior to the final sealing are to fully extend the container into its prismatic shape affording the maximum growing space for the plant and to provide an air cushion giving extra protection to the plant during the early marketing stages of shipment and handling. Over a period of time, as the package is on display on the retail shelf, the osmosis through the plastic film of the container 9 will result in a balancing of pressure between the environment within the container and the outside atmosphere, so that the inflation originally given to the container will be diminished. When this gradual deflation occurs, the upright prismatic shape of the container is maintained by the reinforcing seams 15. Since the container is only capable of a slow osmotic pressure change, it is not subject to rapid deflation, so that the container maintains its effectiveness in cushioning the plant against bumping and jarring.

Within the container 9, the soil bag 10 contains the roots of plant P and the associated soil around the roots. The bag 10 is not hermetically sealed. Along the bottom of the bag, there are a plurality of small holes 25 to allow moisture to enter the soil. As moisture is given off from the leaves of the plant P into the container environment, the moisture collects on the inside of the container walls and falls to the bottom of the container. The collected moisture at the container bottom reenters the soil and plant roots through the holes 25 of soil bag 10. This constant recycling of moisture within the package creates a terrarium effect which permits the plant to survive for an extended period of time without watering. The soil bag 10 is closed along its upper edge 26 by fastening means such as staples 27 with an opening 28 provided which is large enough to facilitate the stem S of the plant. Preferably, the bag 10 is secured to the bottom of the container 9 either by an adhesive or by attachment within the bottom fold of the container as indicated at 29 so that the bag will remain at the bottom of the package even if the package is tipped over, thereby protecting the plant during shipment and handling.

Another use of the plant package of the present invention is depicted in FIG. 5. These packages 8 can be used to thermally protect the plant after planting so that plants stored and sold in packages of this invention can be planted in the ground during the early spring before the final frosts of the planting season. To use the package 8 as thermal protection, the bottom of the container 9 and the bottom of the soil bag 10 are cut and removed, and the plant is placed in a shallow hole which has been dug in the ground G. The soil S in the bag 10 is in contact with the ground, and the plant roots R can begin to take hold in the ground. However, the body 30 of the container is retained over the top of the plant P to provide a thermally protective environment for the plant during late frosts. It has been found that placement of the plastic container over the top of the plant results in a temperature differential of approximately 10° to 12° F between the plant environment and the outside atmosphere. This temperature differential is sufficient to prevent the plant from being damaged by most late springtime frosts. To prevent the plant from outgrowing the size of the container during this early planting period, a growth retardant may be added to the packaging soil in bag 10, and the plastic film of the container 9 may contain a colorant to limit the sunlight transmitted to the plant.

In packaging a plant using the package of the present invention, the outer container 9 and the soil bag 10 are produced separately. The prismatic-like body of the container 9 is produced by first forming a continuous sleeve of tubular double-layered plastic film using a conventional continuous extrusion technique as disclosed in the present inventor's prior U.S. Pat. No. 3,434,652. The upright reinforcing seams 15 are formed using the means 17 and 18 as previously described. After the seams have been formed, the side panels 12 and 14 may be tucked and folded inwardly and the material may be rolled or folded for compact shipment to the plant packager.

When the plant packager receives the length of container material, suitable machinery can be employed to uncoil and cut a length of the material, close one end (i.e., the bottom end) of the length, open the remainder of the length and fill the container with a prepared soil bag 10. These steps performed by the plant packager are conventional and are, therefore, not described in detail. One example of machinery suitable to be used in this procedure is disclosed in the present inventor's prior U.S. Pat. No. 3,503,098.

The soil bag 10 is prepared with the bottom closed but with the top portion 26 completely open. Although a grown plant may be transplanted to the soil bag, the plant is preferably grown right in the bag. The bag 10 is filled with a quantity of soil containing high amounts of insecticide, fungicide and fertilizer. A new plant cutting without root structure is placed into the soil, and the soil is watered regularly until the plant begins to take root and grow in the soil bag 10.

When the plant becomes sufficiently viable, and is ready for packaging the soil moisture is carefully regulated since the plant should not be sealed within the container when the moisture level is high. Before packaging, the leaves of the plant may be coated with a known "leaf shine" material to improve the appearance of the plant for merchandizing display. When the moisture level is sufficiently low, the upper edge 26 of the soil bag is fastened closed such as by staples 27, and the plant is inserted within a container 9 as previously described. The container is then inflated with a controlled volume of dried air. The air used to inflate the container should have a humidity level as close to zero as possible so as not to increase the controlled moisture level within the container. As it is inflated, the container is sealed using the double seal 22 and 23. The plant is now ready for shipment, display and sale.

It is noted that plants grown and packaged in the present invention can be distributed to customers in a practically sterile condition. The plastic film as it is extruded is practically sterile due to the high temperatures during the extrusion process. The plant and soil grown within the soil bag can be produced practically free of fungus, bacteria and insects. In this manner, a plant which is virtually contamination proof can be supplied to the customer.

For very fast growing plants, such as tomato plants, growth retardants can be added to the plant soil to slow the growth of the plant and to permit the plant to remain small enough for the plant package for sufficient periods of time for shipment and marketing.

While the packages shown and described herein are used for a single plant, packages can also be used for multiple plants, since the packages may be of any size. A multiple plant package would have extended container side panels to permit the placement of plurality of plants in a single package. While the invention has been described with respect to its preferred embodiments, these are shown for the purpose of illustration and not limitation. It is understood that other embodiments may be employed without departing the spirit and scope of the invention.

What is claimed is:

1. A packaged plant unit for containing a live plant having roots and a stem which comprises:

soil supporting the plant roots;

a soil receptacle means containing the soil and the plant roots, said receptacle means being closed around the plant stem to retain soil therein and having means for transmitting moisture through the receptacle means to the soil and plant roots; and a container enclosing the entire plant, soil, and receptacle means, said container being light-transmissive, flexible, inflated, and hermetically sealed, the container having generally rectangular side panels connected by upright supporting seams, the material of the container containing therein a surfactant for the prevention of large water droplet formation.

2. A packaged plant unit as in claim 1 wherein the receptacle means is a flexible closed bag.

3. A packaged plant unit as in claim 1 wherein the multiple-layer plastic film is permeable by oxygen and carbon dioxide gas molecules and is substantially impermeable by water.

4. A packaged plant unit as in claim 1 wherein the container is generally prismatic-shaped with a polygonal cross section and generally flat rectangular side panels.

5. A packaged plant unit as in claim 4 wherein the container has a rectangular cross section with four side panels.

6. A packaged plant unit as in claim 1 wherein the container is of a multiple-layered plastic film, the inner layer of which contains the surfactant.

7. A package plant unit as in claim 6 wherein the multiple-layered plastic film has an inner layer of polyethylene and an outer layer of polypropylene.

8. A protective package for the shipment, storage and display of plants, which comprises:

a closed, hermetically sealed, flexible, light-transmissive, plastic container, the container having generally rectangular side panels connected by upright supporting seams, the plastic container being of a multiple-layered film having an inner layer containing a surfactant for the prevention of large water droplet formation, the multiple-layered plastic film being permeable by oxygen and carbon dioxide gas molecules and being substantially impermeable by water; and a closed receptacle within the container for growing medium and plant roots, the receptacle being closed about an opening for a plant stem to retain the growing medium therein and having moisture transmitting apertures therein.

9. A protective package for the shipment, storage, and display of plants, which comprises:

a closed, hermetically sealed, flexible, light-transmissive, plastic container, the container being generally prismatic shaped with a polygonal cross section and generally flat rectangular side panels connected by upright supporting seams, the plastic container being of a film which is multiple-layered with the inner layer containing a surfactant for the prevention of large water droplet formation; and a flexible closed bag within the container for soil and plant roots, the bag having an opening for a plant stem and having moisture transmitting holes therein.

10. A package as in claim 9 wherein the container has a rectangular cross section with four side panels.

11. A package as in claim 9 wherein the bag is secured to the bottom of the container.

12. A package as in claim 9 wherein interior of the container contains gas maintained above atmospheric pressure, so that the container is inflated.

13. A package as in claim 9 wherein the multiple-layered plastic film has an inner layer of polyethylene and an outer layer of polypropylene.

14. A protective package for the shipment, storage, and display of plants, which comprises:

an outer plastic container, said container being closed, hermetically sealed, flexible, inflated, and light-transmissive, and said container being shaped like a rectangular prism with a rectangular cross section and four generally flat rectangular side panels connected by upright supporting seams, the plastic being multiple-layered and having an inner layer of polyethylene and an outer layer of polypropylene, the inner layer also containing a surfactant for the prevention of large water droplet formation; and an inner, flexible, closed bag within and attached to the container for soil and plant roots, the bag having an opening for a plant stem and having moisture transmitting holes therein.

15. A package as in claim 9 wherein the multiple-layered plastic film is permeable by oxygen and carbon dioxide gas molecules and is substantially impermeable by water.

16. A package as in claim 9 wherein the surfactant in the inner layer is approximately 0.25% by weight.

17. A method of packaging a plant for shipment, storage and display, which comprises the steps of:

(1) germinating the plant in an open-topped bag filled with soil;

(2) measuring the moisture content of the soil and adjusting it to the proper level required by the plant;

(3) closing the top of the bag around the plant;

(4) placing the bag in the bottom of a transparent container having a sealed bottom and side portions and an open top;

(5) closing the top of the container;

(6) inflating the container above atmospheric pressure; and (7) hermetically sealing the container while inflated with the germinated plant and closed soil bag inside;

steps (3), (4), (5), (6) and (7) being performed only when the moisture level measured and adjusted in step (2) is at the proper level.

18. A method as in claim 17 comprising the additional step of adding fertilizer, insecticide and fungicide to the soil in the bag.

19. A method as in claim 17 wherein the inflating and sealing steps comprise:

forming a first seal across the top of the container;

inserting a needle means through the first seal;

applying pressure through the needle means to inflate the container;

withdrawing the needle means; and forming a second seal in the container as the needle means is withdrawn.

20. A method as in claim 17 comprising the additional step of attaching the bag to the bottom of the container.

21. A method as in claim 17 wherein the container is inflated by introducing dry air into the container to maintain the moisture level measured and adjusted in step (2).

22. A method as in claim 17 comprising the additional step of allowing oxygen and carbon dioxide gas molecules to permeate the sealed container while preventing water from permeating the container to allow the plant to grow in the sealed container.

23. A method of packaging and transplanting a plant which comprises the steps of:

packaging the plant as in claim 14;

preparing a hole larger than the size of the container;

removing the bottom portion of the container to provide access to the bag;

removing the bottom portion of the bag to expose the soil therein;

placing the container and bag with removed bottom portions into the hole;

maintaining the container over the plant to protect the plant against adverse weather;

removing the remainder of the container from the plant when the weather becomes suitable for unprotected growth.

* * * * *